US005186639A

United States Patent [19]

Comerci et al.

[11] Patent Number: 5,186,639

[45] Date of Patent: Feb. 16, 1993

[54] ELECTRICAL CONNECTOR WITH PLUG DETECTION SWITCH

[75] Inventors: Joseph D. Comerci, Elmhurst; Robert DeRoss, Naperville, both of Ill.

[73] Assignee: Molex Incorporated, Lisle, Ill.

[21] Appl. No.: 819,251

[22] Filed: Jan. 9, 1992

[51] Int. Cl.[5] ..... H01R 33/54

[52] U.S. Cl. ..... 439/188; 200/51.1; 200/51.09; 439/512; 439/489

[58] Field of Search ..... 439/188, 489, 512, 514, 439/515; 200/51 R, 51.09-51.11

[56] References Cited

U.S. PATENT DOCUMENTS

| | | | |
|---|---|---|---|
| 3,701,074 | 10/1972 | Oster | 439/188 |
| 4,389,551 | 6/1983 | Deibele et al. | 200/51 R |
| 4,426,558 | 1/1984 | Tanaka et al. | 200/51.09 |
| 4,623,209 | 11/1986 | Mangone | 339/75 P |
| 4,861,281 | 8/1989 | Warner | 439/540 |
| 5,006,675 | 4/1991 | Sakaguchi | 200/51.1 |

*Primary Examiner*—Paula A. Bradley
*Attorney, Agent, or Firm*—Stephen Z. Weiss

[57] ABSTRACT

A plug detection electrical receptacle includes a dielectric housing having at least one passage with an open end for receiving a male terminal of a complementary mating electrical plug. A female terminal is disposed in the passage for engagement by the male terminal. A detect switch is located in proximity to the passage for actuation by the male terminal when the male terminal is inserted into the passage in engagement with the female terminal. The detect switch includes a detect contact engageable by a resilient actuator contact, with the resilient actuator contact having an insulating separator fixed thereto. The insulating separator is disposed in a path of insertion of the male terminal for engagement by the male terminal to bias the resilient actuator contact into engagement with the detect contact to close a circuit therethrough. The detect contact and the resilient actuator contact are inserted into passageways in the housing, the passageways having open ends in the same side of the housing as the open end of the passage for the female terminal, whereby the contacts and the terminal can be assembled into the housing in the same direction on the same side of the housing.

7 Claims, 2 Drawing Sheets

32
30
34
58
24
22b
38
62
36
26
42
24
22a
22a
20
52
4
20
22b
26
28
4
22a
22a
14
20
28
14
16
28
18
34
12
28
18
34
16
10
16

ELECTRICAL CONNECTOR WITH PLUG DETECTION SWITCH

FIELD OF THE INVENTION

This invention generally relates to the art of electrical connectors and, particularly, to an electrical connector which has an internal switch to detect the presence of a properly inserted plug.

BACKGROUND OF THE INVENTION

Various electrical connectors or receptacles are available in which an internal switch is incorporated in the connector to detect the presence of a properly inserted plug connector. Usually, the receptacle is normally "dead" (i.e., it does not receive current) unless the detection switch is actuated. Such systems might be used as a simple safety measure. For instance, the detection switch might be used to detect the presence of a ground terminal of a three-pronged plug. If a two-pronged plug is inserted into the receptacle, the switch will not be actuated and no current will be supplied to the receptacle unless a proper three-pronged plug is inserted into the receptacle, whereupon the ground terminal actuates the detection switch.

In certain "smart" power receptacles, it is desirable not to supply power to the receptacle unless a power plug is inserted into the receptacle. The detection switch might be actuated by any one of the prongs or blades of the power receptacle, at which point the detection switch is actuated to tell a system controller to send power to the receptacle.

Another example might be used where a system has battery power backup. If the battery is constantly in an "on" mode, such as when receiving full line power, the battery would be rapidly drained. Consequently, the detection switch might be used to disconnect the battery power in the presence of a plug inserted into the receptacle.

In some detection switches, the contacts of the switches are deflected indirectly by a terminal prong or blade through a separator made of an insulating material. This is particularly true in a power receptacle since the detection switch usually is a low voltage switch. The insulator provides electrical isolation between the low voltage circuit and the higher voltage circuit of the power receptacle.

One of the problems with electrical connectors or receptacles which embody detection switches is that the receptacles are very unduly complicated or require excessive components. If not complicated, the receptacles are not cost effective because of assembly procedures involved in assembling the detection switch within an otherwise simple electrical connector or receptacle. This invention is directed to solving these problems by providing a very simple plug detection electrical receptacle, and the receptacle is very easy to assemble, with all of the components being assembled into a housing in a single direction.

SUMMARY OF THE INVENTION

An object, therefore, of the invention is to provide a new and improved plug detection electrical connector or receptacle of the character described.

In the exemplary embodiment of the invention, an electrical receptacle includes a dielectric housing having at least one passage with an open end for receiving a male terminal of a complementary mating electrical plug. A female terminal is disposed in the passage for engagement by the male terminal. A detect switch is located in proximity to the passage for actuation by the male terminal when the male terminal is inserted into the passage in engagement with the female terminal.

The invention contemplates that the detect switch include a detect contact engageable by a resilient actuator contact, with the resilient actuator contact having an insulating separator fixed thereto. The insulating separator is disposed in a path of insertion of the male terminal for engagement by the male terminal to bias the resilient actuator contact into engagement with the detect contact to close a circuit therethrough. In the illustrated embodiment, the resilient actuator contact is in the form of an elongated blade having the insulating separator fixed to one end thereof. The separator is in the form of an insulator block having an angled camming surface in the path of movement of the resilient actuator contact.

The invention also contemplates the receptacle housing having first and second passageways for receiving the resilient actuator contact and the detect contact of the contact switch, the passageways having open ends in the same side of the housing as the open end of the passage for the female terminal. Therefore, the actuator contact and detect contact can be easily assembled into the housing in the same direction and on the same side of the housing as the female terminal. The actuator contact may have the insulating separator preassembled thereto.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
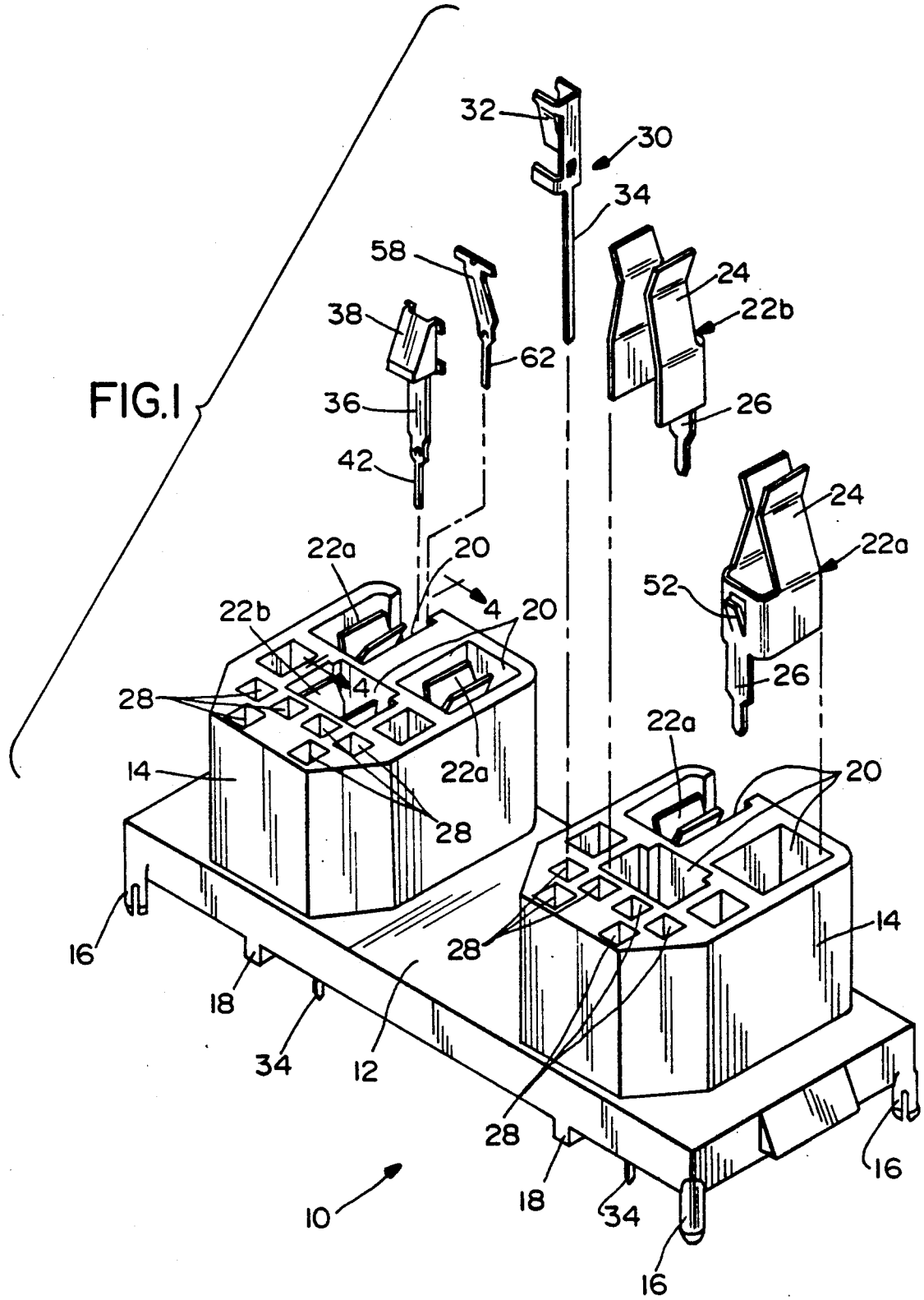
FIG. 1 is an exploded perspective view of an electrical receptacle module embodying the concepts of the invention.

Referring to the drawings in greater detail, and first to FIG. 1, the invention is embodied in an electrical receptacle module, generally designated 10, which includes a generally flat base 12 and a pair of upstanding housings 14. The base and housings are unitarily molded of dielectric material, such as plastic or the like. The module is designed for mounting onto a printed circuit board by means of bifurcated mounting posts 16 positionable into appropriate mounting holes in the printed circuit board. Standoffs 18 engage the surface of the board and space base 12 therefrom.

Each housing 14 is substantially identical and includes passages 20 for receiving female power terminals, generally designated 22*a* and 22*b*. The power terminals are substantially identical, except for their orientation, as seen by the isolated terminals 22*a* and 22*b* above the righthand housing 14 shown in FIG. 1. Each terminal includes a receptacle end 24 for receiving a male terminal prong or blade of a complementary mating electrical plug (not shown). Each terminal also includes a tail portion 26 which projects out of the bottom of base 12 for insertion into appropriate holes in the printed circuit board. The tails may form solder tails for soldering to circuit traces on the board or in the holes. As seen in FIG. 1, female terminal 22*a* is a power terminal and female terminal 22*b* is a ground terminal.

Each housing 14 also has a plurality of passages 28 for receiving a plurality of female data terminals, generally designated 30. Each data terminal includes a receptacle portion 32 for receiving data terminal pins from the complementary mating electrical plug, along with solder tail portions 34 for projecting below base 12 into appropriate holes in the printed circuit board for electrical connection to data circuit traces on the board.

From the foregoing, it can be understood that each housing 14 and its respective power and data terminals form an electrical receptacle for mating with a complementary electrical plug, the two receptacles being unitary with base 12 to form the composite electrical receptacle module 10 mountable to a printed circuit board. Therefore, from this point on, the following description generally will be applicable to only one of the receptacles and its housing 14 and power and ground terminals 22*a* and 22*b*, respectively.

Generally, the invention contemplates providing a detect switch located in each housing 14 in proximity to the passage for receiving ground terminal 22*b* for actuation by a grounding male terminal of the complementary mating connector. However, it should be understood that the invention is equally applicable for use with any type of electrical connector and any of its respective terminals.

Figure 2:
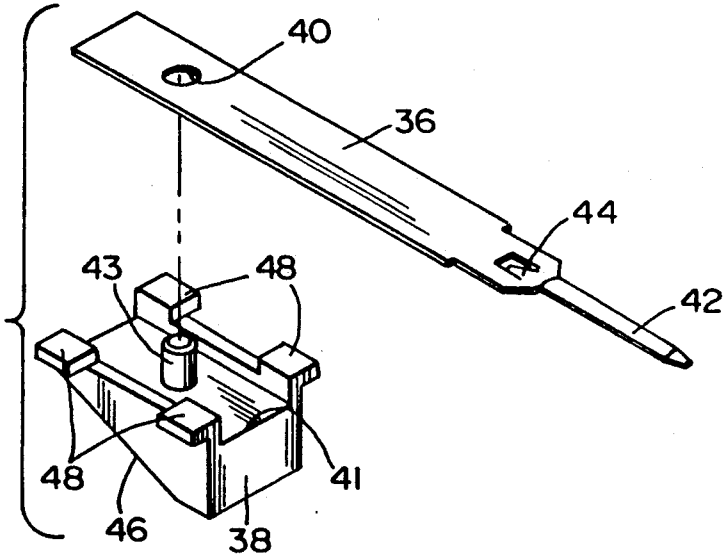
FIG. 2 is an exploded perspective view of the resilient actuator contact and insulating separator of the detect switch.
Figure 3:
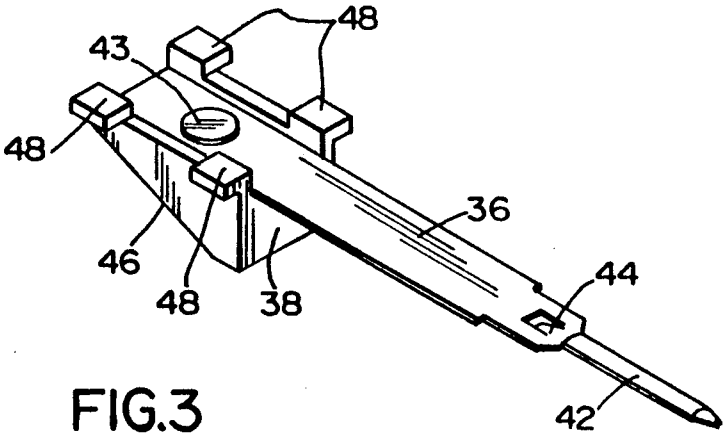
FIG. 3 is a perspective view of the resilient actuator contact and insulating separator in preassembled condition.

Before proceeding with a complete description of the detect switch, reference is made to FIGS. 2 and 3 where a resilient actuator contact 36 is shown in conjunction with an insulating separator 38. The actuator is in the form of a flat metal blade having a hole 40 near one end and a solder tail 42 at the opposite end. A locking tab 44 is stamped out of blade 36 immediately inside solder tail 42. Insulating separator 38 is provided in the form of a molded block of dielectric material, such as plastic or the like. The separator includes a trough 41 for receiving the blade of actuator contact 36, and a pin 43 projects outwardly of trough 41 for insertion through hole 40 of the contact. The separator also has an angled camming surface 46 and a plurality of generally flat positioning flanges 48, for purposed described hereinafter.

The invention contemplates that insulating separator 38 be fixed to resilient actuator contact 36 before assembly into a respective housing 14. Specifically, as seen in the preassembled depiction of FIG. 3, the contact is positioned into trough 41 of the separator, and post 42 is ultrasonically staked so that the contact is fixed rigidly in the trough of the separator.

Figure 4:
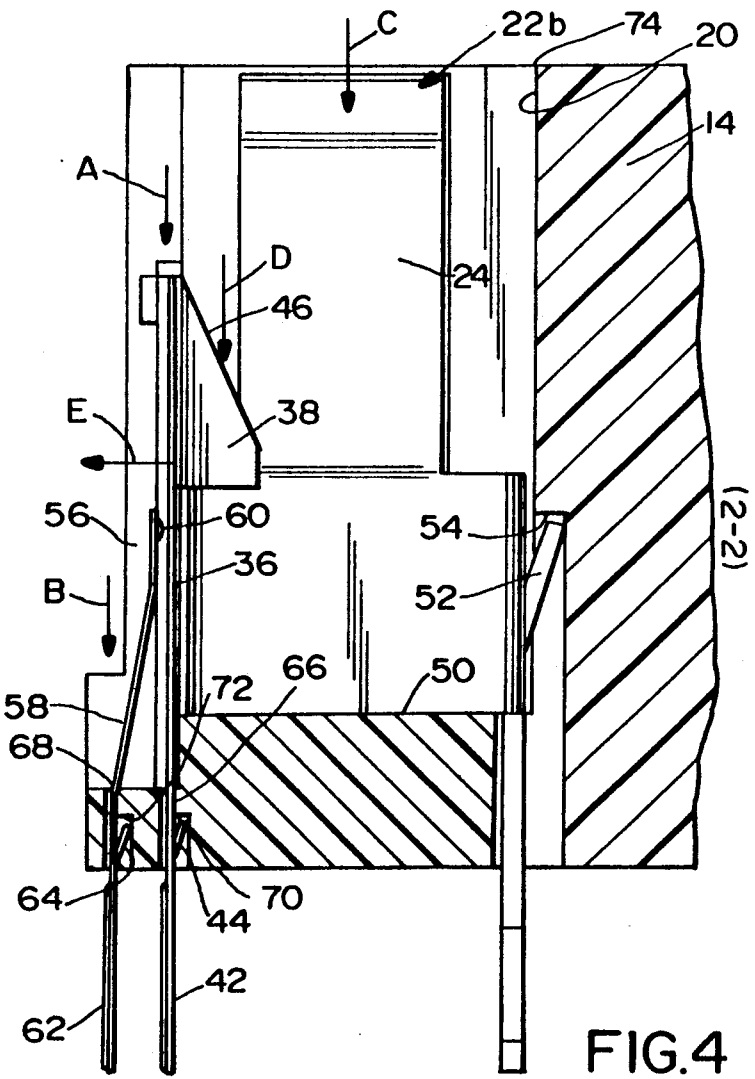
FIG. 4 is a section taken generally along line 4—4 of FIG. 1.

Referring to FIG. 4 in connection with FIG. 1, it can be seen that female ground terminal 22*b* is inserted into its respective passage 20 of housing 14. The terminal bottoms out on an internal wall 50 of the housing, and a locking tab 52 of the terminal snaps behind a locking shoulder 54 in one side of the passage within the housing. A detect switch, generally designated 56, is mounted in housing 14 in proximity to passage 20 for actuation by a male terminal when the male terminal is inserted into the passage and in engagement with receptacle portion 24 of female terminal 22*b*.

More particularly, detect switch 56 includes resilient actuator contact 36, along with insulating separator 38 which is fixed to the upper end of the resilient actuator contact, as described above. The detect switch also includes a detect contact 58 in the form of a resilient blade and which can be seen in FIGS. 1 and 4. The blade has an inwardly projecting contact dimple 60 for engagement by actuator contact blade 36. Detect contact 58 also has a solder tail portion 62 and a locking tab 64 similar to the same components described above with relation to actuator contact 36.

In assembly, actuator contact 36 is inserted into housing 14 in the direction of arrow "A" into a passageway 66 near the bottom of the housing. Detect contact 58 is inserted into a second passageway 68 in the housing in the direction of arrow "B". Locking tabs 44 and 64 of actuator contact 36 and detect contact 58, respectively, snap behind respective locking shoulders 70 and 72 formed in passageways 66 and 68, respectively. With female terminal 22*b* being assembled into housing 14, into an open end 74 (FIG. 4) of passage 20 in the direction of arrow "C", it can be seen that all of the terminals of the receptacle and the contacts of the detect switch are assembled into the housing in the same direction on the same side of the housing. In the exemplary embodiment, all of the terminals and contacts are inserted into the open ends of the passages and passageways from the top of the housing as shown clearly in FIG. 1. This greatly simplifies the assembly operation of the entire electrical connector and renders the connector very cost effective.

In operation, and referring to FIG. 4, it can be seen that insulating separator 38 projects into receptacle portion 24 of female terminal 22*b*, i.e., in the path of insertion of a male terminal of the complementary mating electrical plug. When the male terminal is inserted into female terminal 22*b*, the male terminal engages angled camming surface 46 of insulating separator 38, as indicated by arrow "D", whereupon resilient actuator contact 36 is biased outwardly in the direction of arrow "E" and into engagement with contact dimple 60 of detect contact 58 of detect switch 56. On removal of the mating electrical plug, the male terminal will move out of engagement with insulating separator 38, whereupon resilient actuator contact 36 will move back to the non-contacting position shown in FIG. 4 under its own resiliency.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a plug detection electrical receptacle which includes a dielectric housing having at least one passage with an open mating end for receiving a male terminal of a complementary mating electrical plug, a female terminal disposed in the passage for engagement by the male terminal, and a detect switch located in proximity to the passage for actuation by the male terminal when the male terminal is inserted into the passage in engagement with the female terminal, wherein the improvement in said detect switch comprises a detect contact engageable by a resilient actuator contact with the resilient actuator contact having an insulating separator non-removably fixed thereto, the insulating separator being disposed in a path of insertion of the male terminal for engagement by the male terminal to bias the resilient actuator contact into engagement with the detect contact to close a circuit therethrough.

2. In a plug detection electrical receptacle as set forth in claim 1, wherein said resilient actuator contact-comprises an elongated blade having said insulating separator non-removably fixed to one end thereof.

3. In a plug detection electrical receptacle as set forth in claim 2, wherein said insulating separator comprises an insulator block having an angled camming surface in said path for engagement by the male terminal.

4. In a plug detection electrical receptacle as set forth in claim 1, wherein the housing of the receptacle includes a passageway for receiving the resilient actuator contact of the detect switch, and said improvement further including an open mating end of the passageway being in the same side of the housing as the open mating end of the passage for the female terminal, whereby the actuator contact and the insulating separator fixed thereto and the female terminal can be assembled into the housing in the same direction on the same side of the housing.

5. In a plug detection electrical receptacle as set forth in claim 4, wherein the housing of the receptacle includes a second passageway for receiving the detect contact of the detect switch, and said improvement further including an open end of the second passageway being in said same side of the housing, whereby the detect contact, the actuator contact and the female terminal all can be assembled into the housing in the same direction on the same side of the housing.

6. In a plug detection electrical receptacle which includes a dielectric housing having at least one passage with an open end for receiving a male terminal of a complementary mating electrical plug, a female terminal disposed in the passage for engagement by the male terminal, and a detect switch located in proximity to the passage for actuation by the male terminal when the male terminal is inserted into the passage in engagement with the female terminal, the detect switch including a detect contact engageable by a resilient actuator contact in response to insertion of the male terminal into the female terminal, wherein the improvement comprises said housing having a passageway for receiving the resilient actuator contact of the detect switch, and an open mating end of the passageway being in the same side of the housing as the open mating end of the passage for the female terminal, whereby the actuator contact and the female terminal can be assembled into the housing in the same direction on the same side of the housing.

7. In a plug detection electrical receptacle as set forth in claim 6, wherein the housing of the receptacle includes a second passageway for receiving the detect contact of the detect switch with an open end of the second passageway being in said same side of the housing, whereby the detect contact, the actuator contact and the female contact all can be assembled into the housing in the same direction on the same side of the housing.

* * * * *